United States Patent [19]

Goodlaxson

[11] 3,986,373

[45] Oct. 19, 1976

[54] DRIVE SYSTEM FOR A LAUNDRY APPARATUS

[75] Inventor: John D. Goodlaxson, Colfax, Iowa

[73] Assignee: The Maytag Company, Newton, Iowa

[22] Filed: June 27, 1975

[21] Appl. No.: 591,045

[52] U.S. Cl. ..... 68/23.7; 68/208; 192/94

[51] Int. Cl.[2] ..... D06F 23/04; D06F 37/40

[58] Field of Search ..... 68/23.7, 184, 208; 192/94

[56] References Cited

UNITED STATES PATENTS

| | | | |
|---|---|---|---|
| 2,869,344 | 1/1959 | Bochan | 68/23.7 X |
| 3,116,626 | 1/1964 | Moschetti et al. | 68/23.5 |
| 3,197,982 | 8/1965 | Worst | 68/23.7 X |

*Primary Examiner*—Philip R. Coe
*Attorney, Agent, or Firm*—Richard L. Ward

[57] ABSTRACT

A drive system for a laundry apparatus including a torque sensing drive mechanism for determining the presence of washing fluid in the cavity of a rotary positive displacement pump by means of the different resistive torque responses of relatively full and empty pump cavities. A clutch mechanism joins two driving pulleys that are belt-connected to two driven pulleys on the transmission and pump units. The presence of washing fluid in the pump cavity effects separation of the driving pulleys and actuates only the pump unit. Absence of washing fluid in the pump cavity causes the driving pulleys to remain coupled and a centrifugal extraction operation is initiated through the transmission and spin clutch.

9 Claims, 4 Drawing Figures

DRIVE SYSTEM FOR A LAUNDRY APPARATUS

BACKGROUND OF THE INVENTION

1. Field of the Invention

This invention relates to a drive system and more particularly to a drive arrangement for sensing, through resistive torque, the presence of washing fluid in the cavity of a rotary positive displacement pump.

2. Description of the Prior Art

The prior art shows a continuing search for a system that senses the tub water level and provides a means of lowering the level prior to a period of high speed extraction. Previous work in the appliance field shows systems that disclose electrical or pressure systems for sensing this water level. These systems are used in conjunction with slip clutches or solenoid actuated clutches which are energized, when the water level is reduced to a predetermined level, to activate the extractor. Also shown in prior art is a system that uses a pump for both drain and agitation. In this prior art pump system, a slip clutch is arranged so that the fabric basket will gradually come up to extraction speed as the fluid level in the tub is lowered by pumping out.

SUMMARY OF THE INVENTION

It is an object of the instant invention to provide a drive system for a laundry apparatus that will sense the presence of washing fluid in the tub by the resistive torque on the rotary positive displacement pump.

It is a further object of the instant invention to provide a drive system for a laundry apparatus that will allow engagement of the pump alone during at least the initial portion of the pump out operation.

It is a further object of the instant invention to provide automatic pump out of fluid from a laundry apparatus prior to effecting centrifugal extraction of liquid from fabrics in the laundry apparatus.

Briefly, the instant invention achieves these objects in a drive system for a laundry apparatus that includes a motor-driven drive mechanism and associated drive means selectively operating a rotary positive displacement pump and a centrifugal extractor transmission.

Operation of the system and further objects and advantages thereof will become evident as the description proceeds and from an examination of the accompanying three pages of drawings.

BRIEF DESCRIPTION OF THE DRAWINGS

The drawings illustrate a preferred embodiment of the invention with similar numerals referring to similar parts throughout the several views wherein.

DESCRIPTION OF A PREFERRED EMBODIMENT

Figure 1:
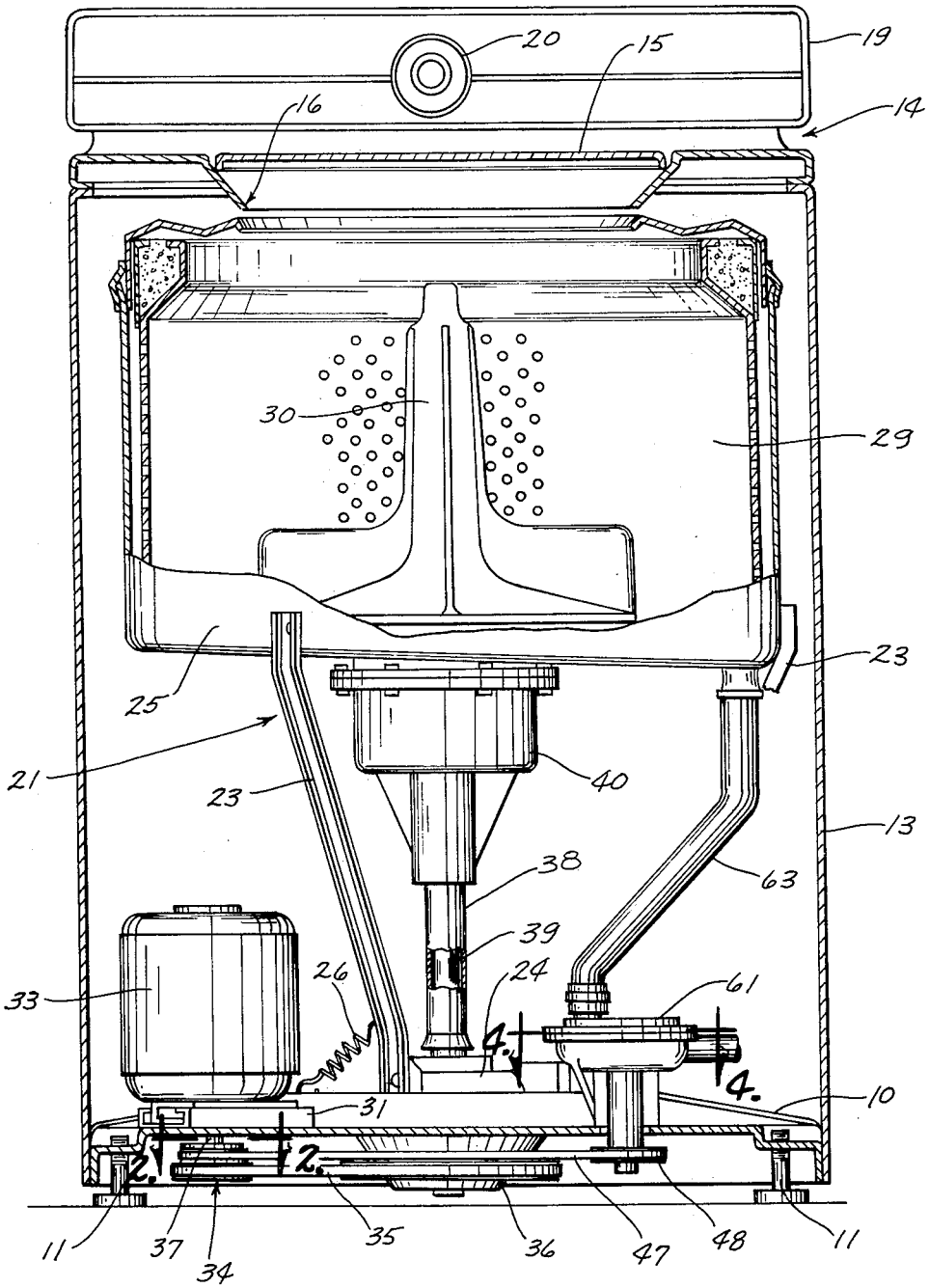
FIG. 1 is an overall view of an automatic washing machine with various components broken away to show portions of the drive system incorporating the instant invention.

Referring to FIG. 1 there is shown an automatic washing machine including a base frame 10 supported on a plurality of adjustable legs 11 and mounting a cabinet comprising a sidewall 13 and a top cover 14. The top cover 14 includes a hinged panel comprising an access door 15 normally covering a recessed loading opening 16 and movable to an open position to permit access through the opening 16. The top cover 14 further includes an upwardly extending housing 19 for accommodating various control members such as programming means actuatable by a dial 20.

The washing machine is provided with controls for programming the machine through a sequence of operations including energization of the motor 33 for operation in a first direction to effect a washing and/or rinsing function followed by energization of the motor 33 in a second direction to effect a liquid removal function.

Mounted within the cabinet is a tub assembly 21 nutationally supported on the base frame 10 by an inverted tripod arrangement including tub braces 23 which are connected at the lower end to a support member 24 positioned on and movable relative to a dome portion of the base frame 10. The tub braces 23 are connected at their upper ends to a generally imperforate outer liquid container or tub 25. The tub braces 23 are also resiliently connected to the base frame 10 by means of centering springs 26 which resist rotation of the support member 24 relative to the base frame 10 but permit nutational movement relative to the base frame 10.

Revolubly mounted in the imperforate outer tub 25 is a perforate clothes basket or fabric basket 29 in which is positioned an oscillatable agitator 30 for effecting movement of the fabrics and washing fluid within the tub assembly. The imperforate outer tub 25 and the perforate inner fabric basket 29 are substantially aligned with the loading opening 16 in the top cover 14 for permitting the operator to place articles within the fabric basket 29 and remove them upon completion of the cycle.

The base frame 10 also supports through a motor mount 31 the reversible drive motor 33 which is operable in a bidirectional drive system for selectively effecting oscillation of the agitator 30 or centrifugal rotation of the inner fabric basket 29.

As generally shown in FIG. 1, the base frame 10 also supports the pumping means that is driven by the motor 33. The pump 61 communicates with the outer tub 25 through the conduit 63 and is operable for pumping liquids from the outer tub 25 toward an external drain when the motor 33 is operated in the direction for effecting centrifugal extraction. Since the pump 61 is drivingly connected to the bidirectional motor 33 and is operable in the first and second directions with the motor 33, the pump 61 will tend to pump liquid toward the outer tub 25 through the conduit 63 when the motor 33 is operating in the direction for effecting agitation of the fabrics during the washing portion of the cycle.

Figure 2:
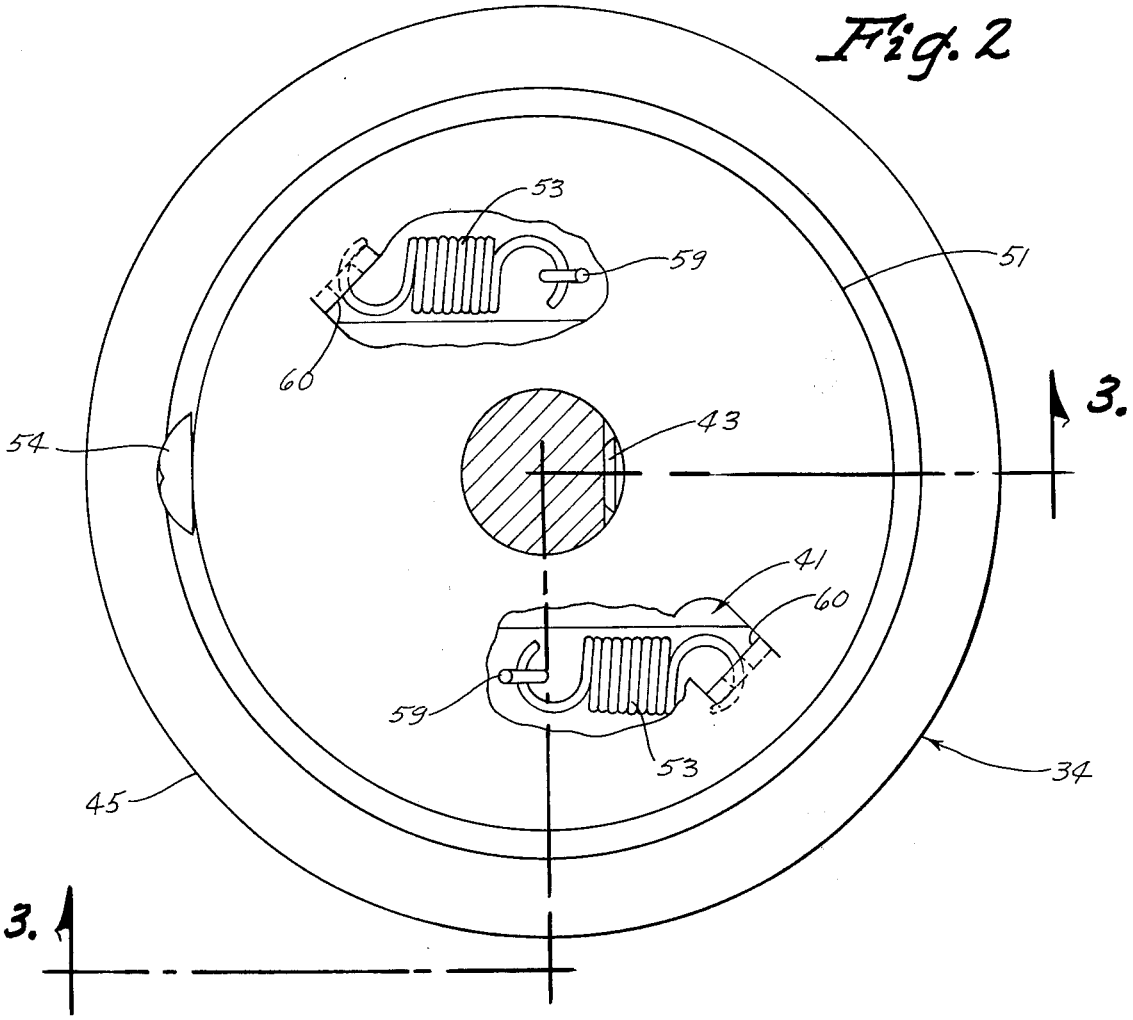
FIG. 2 is a top view of the drive mechanism taken along Lines 2—2 of FIG. 1 with a portion of the spring cover broken away to show the torque opposing springs.
Figure 3:
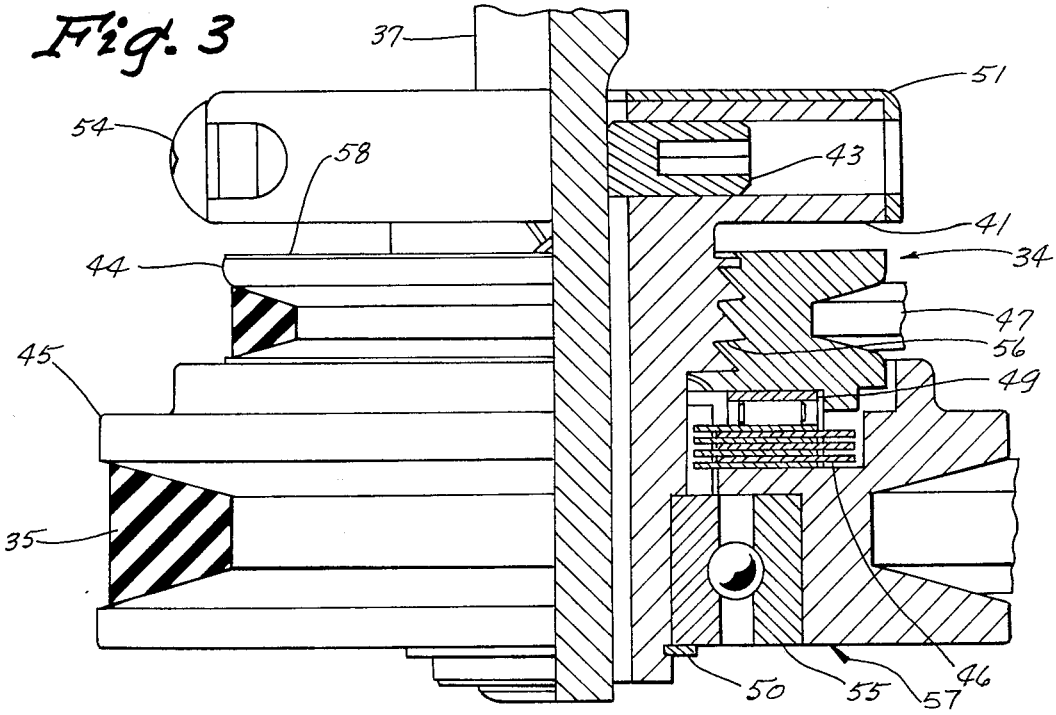
FIG. 3 is a sectional view of the drive mechanism taken along Lines 3—3 of FIG. 2.

The drive mechanism 34 mounted on the shaft 37 of the drive motor 33, as best shown in FIGS. 2 and 3, consists of several elements: a hub 41, a set screw 43, a pump drive pulley 44, an agitate-spin drive pulley 45, clutch disks 46, a roller thrust bearing 49, a retaining ring 50, a spring cover 51, springs 53, ball bearing 55, drive pins 59 and an adjustment screw 54. The hub 41 attaches the drive mechanism 34 to the drive motor shaft 37 by means of the set screw 43 engaging a flat portion of the motor shaft 37. The outer surface of the hub 41 includes a four start external buttress thread 56 which engages with a like internal thread on the pump drive pulley 44. The roller thrust bearing 49 is located between the underside of the pump drive pulley 44 and the first of the clutch disks 46. This bearing 49 absorbs the end thrust present when the clutch is fully engaged as in agitation. The preferred embodiment shows an uneven number of clutch disks 46 which are alternately keyed to rotate either with the hub 41 or with the agitate-spin drive pulley 45. In the embodiment shown, the preferred number of disks 46 is seven. An even number of disks 46 will cause the roller thrust bearing 49 to run when the clutch is disengaged. The agitate-spin drive pulley 45 has a ball bearing 55 pressed into its inner diameter. This pulley-bearing assembly 57 is secured to the hub 41 by the retaining ring 50.

Two drive pins 59 are pressed into the top surface 58 of the pump drive pulley 44, spaced diametrically apart, and are at an angle less than perpendicular to the pulley top surface 58. These pins 59 provide a connecting point for one end of the torque opposing springs 53 with the other end of the springs 53 fastened to downwardly projecting ears 60 on the spring cover 51. These torque opposing springs 53 can be adjusted to a predetermined setting by rotating the spring cover 51 relative to the hub 41 and the pulley top surface 58 with a tool and locking the cover 51 to the hub 41 with the adjustment screw 54. These springs 53 oppose the disengaging of the pulleys so that light driving torque as with an empty pump will not disengage the clutch, thus enabling both pulleys to drive. Heavy pump resistive torque as with a full pump will effect disengagement of the pulleys and allow driving of only the pump pulley.

As generally shown in FIG. 1, the drive system for effecting operation of the agitator 30 and rotation of the fabric basket 29 includes the drive mechanism 34 on the shaft 37 of the drive motor 33. This drive mechanism 34 has agitate-spin pulley 45 and pump pulley 44 with the agitate-spin pulley 45 drivingly engaged with a main drive belt 35 which in turn is drivingly engaged with the main drive pulley 36 under predetermined conditions of the drive mechanism 34. The main drive pulley 36 is drivingly connected to either the agitator 30 through a drive shaft 39 and the gearing of a transmission 40 or to the fabric basket 29 through the drive tube 38 and housing of the transmission 40 and a spin clutch (not shown) depending on the direction of rotation of the motor 33. The pump drive pulley 44 is drivingly engaged with a pump drive belt 47 which in turn is drivingly engaged with the pump pulley 48 for driving the pump pulley 48 under predetermined conditions of the drive mechanism 34 to initiate a pump out.

Operation of the motor 33 in a first direction effects rotation of the main drive pulley 36 for effecting oscillation of the agitator 30 through the drive shaft 39 and transmission gearing. In this direction of rotation, the pump drive pulley 44 is rotated down the hub helix, fully engaging the clutch disks 46, effecting rotation of both pump pulley 48 and main drive pulley 36, thereby simultaneously effecting the pumping of washing fluid toward the tub 25 and oscillation of the agitator 30.

Figure 4:
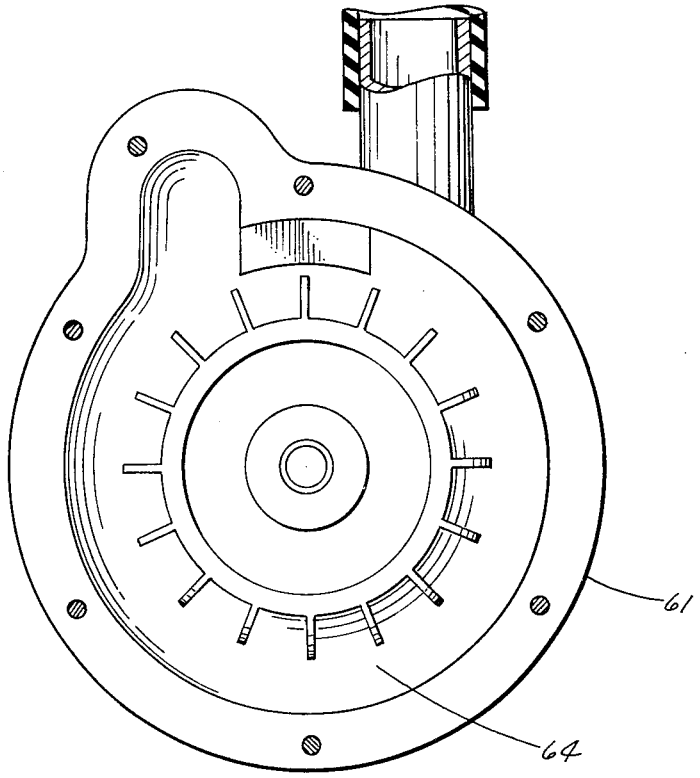
FIG. 4 is a sectional view of the pump taken along Lines 4—4 of FIG. 1.

Operation of the motor 33 in the opposite direction will effect either a pump out or a high speed extraction operation dependent on whether or not there is any fluid in the tub 25. If there is fluid in the tub 25, the resistive torque of the fluid in the pump cavity 64 will cause the two drive pulleys to separate and only the pump drive pulley 44 will turn thus initiating a pump out. As the resistive torque diminishes, the pulleys will again be joined through the clutch mechanism and the centrifugal extraction operation will begin. The pumping means is preferably a rotary turbine type pump having positive displacement characteristics such as the turbine pump 61, as shown in FIG. 4, since a centrifugal pump will not provide the resistive torque required for disengagement of the clutch mechanism to provide a pump out prior to centrifugal extraction.

It is therefore seen that the instant invention provides clear and distinct advantages over the drive systems shown in the prior art. The pump out or drain operation is automatically achieved prior to centrifugal extraction without a separate motor being required. Because of the automatic drain operation, the fabrics being washed are allowed to settle to the bottom of the fabric basket prior to centrifugal extraction making balancing of the basket less critical. If the pump 61 should become blocked while water remains in the tub, this drive system will not allow the machine to begin the extraction operation therefore eliminating the possibility of overflowing the top of the tub. If the timer knob is manually advanced past the first part of the extraction period, this drive system will sense the presence of water in the tub and give a pump out prior to centrifugal extraction. Also, the drive motor is not required to accelerate the fabric basket to extraction speed in a full tub of water.

In the drawings and specification there has been set forth a preferred embodiment of the invention and although specific terms are employed these are used in a generic and descriptive sense only and not for purpose of limitation. Changes in form and proportion of parts, as well as the substitution of equivalents, are contemplated, as circumstances may suggest or render expedient, without departing from the spirit or scope of this invention as defined in the following claims.

I claim:

1. In a laundry apparatus for performing a washing operation and a liquid extraction operation, the combination comprising: means for performing said washing and extraction operations including a tub, a fabric basket within said tub, and agitation means within said fabric basket; conduit means connected to said tub for conducting liquid from said tub to an external drain; pump means communicating with said conduit means and operable for pumping liquid from said tub to said external drain during said extraction operation; driven means operable to effect said washing operation including operation of said agitation means and to effect said extraction operation including high speed rotation of said basket; a motor including a drive shaft and operable for driving said driven means and said pump means; control means controlling the operation of said motor during said washing and extraction operations; and drive means on said motor drive shaft and operable for selectively driving only said pump means for a period of time to effectively remove fluid from said tub during said extraction operation before said driven means is operable for effecting rotation of said fabric basket, said drive means including clutch means responsive to the substantial removal of fluid from said tub for effecting a driving connection to said driven means while continuing the driving of said pump means.

2. A laundry apparatus as described in claim 1 wherein said drive means includes a first pulley rotatable with said motor shaft for driving said pump means and a second pulley rotatable with said first pulley through said clutch means for driving said agitation means and effecting rotation of said fabric basket.

3. In a laundry apparatus for performing a washing operation and a liquid extraction operation, the combination comprising: means for performing said washing and extraction operations including a tub, a fabric basket within said tub, and agitation means within said fabric basket; conduit means connected to said tub for conducting liquid from said tub to an external drain; pump means communicating with said conduit means and operable for pumping liquid from said tub to said external drain during said extraction operation; driven means to effect said washing operation including operation of said agitation means and to effect said extraction operation including high speed rotation of said basket; a motor including a drive shaft and operable for driving said driven means and said pump means; control means controlling the operation of said motor during said washing and extraction operations; drive means including clutch means on said motor drive shaft and including first and second pulleys; and means for drivingly connecting said first pulley to said pump means and said second pulley to said driven means, said drive means being operable for drivingly connecting said first pulley to said drive shaft for rotation therewith and to maintain said second pulley drivingly disconnected from said drive shaft to effectively remove fluid from said tub without effecting rotation of said basket, said clutch means being further operable to effect rotation of said second pulley with said first pulley and drive shaft responsive to the substantial removal of fluid from said tub whereby said pump means is operable for effectively removing fluid from said tub during said extraction operation before said driven means is operable for effecting high speed rotation of said fabric basket.

4. A laundry apparatus as described in claim 3 wherein said second pulley is drivingly disconnected from said drive shaft during at least a portion of the cycle responsive to a predetermined resistive torque on said first pulley to effect rotation of only said first pulley.

5. In a laundry apparatus for performing a washing operation and a liquid extraction operation, the combination comprising: means for performing said washing and extraction operations including a tub, a fabric basket within said tub, and agitation means within said fabric basket; conduit means connected to said tub for conducting liquid from said tub to an external drain; pump means communicating with said conduit means for pumping liquid from said tub to said external drain during said extraction operation; driven means operable to effect said washing operation including operation of said agitation means and to effect said extraction operation including high speed rotation of said basket; a motor including a drive shaft and operable for driving said driven means and said pump means; control means controlling the operation of said motor during said washing and extraction operations; drive means including clutch means on said motor drive shaft and including first and second pulleys; and means for drivingly connecting said first pulley to said pump means and said second pulley to said driven means, said drive means being operable for drivingly connecting said first pulley to said drive shaft for rotation therewith and for maintaining said second pulley drivingly disconnected from said first pulley and said drive shaft responsive to a predetermined resistive torque on said first pulley, the resistive torque on said first pulley being a function of the quantity of liquid in said pump means and being at least as high as said predetermined resistive torque with washing fluid in said tub and being less than said predetermined resistive torque with the washing fluid substantially removed from said tub whereby said pump means is operable for effectively removing fluid from said tub during said extraction operation before said driven means is operable for effecting rotation of said fabric basket.

6. A laundry apparatus as described in claim 5 wherein said clutch means includes adjustable spring means for maintaining a biasing force on said clutch means for effecting engagement of said first and second pulleys when said resistive torque is less than said predetermined resistive torque.

7. In a laundry apparatus for performing a washing operation and a liquid extraction operation, the combination comprising: means for performing said washing and extraction operations including a tub, a fabric basket within said tub, and agitation means within said fabric basket; conduit means connected to said tub for conducting liquid from said tub to an external drain; a reversible motor operable in a first direction and in a second reverse direction; rotary positive displacement pump means communicating with said conduit means and operated by said reversible motor for pumping toward said tub when said motor is rotated in said first direction during said washing operation and for pumping liquid from said tub to said external drain when said motor is rotated in said reverse direction during said extraction operation; driven means rotatable in said first direction to effect said washing operation including operation of said agitation means and rotatable in said reverse direction to effect said extraction operation including high speed rotation of said basket, said reversible motor including a drive shaft and operable for driving said reversible driven means and said pump means; control means controlling the operation of said motor during said washing and extraction operations; and drive means including clutch means, a first pulley for drivingly connecting said drive motor to said pump means, and a second pulley for drivingly connecting said drive motor to said driven means, said first pulley being rotatable with said motor drive shaft while said second pulley is nonrotatable with said motor drive shaft responsive to a predetermined resistive torque on said first pulley, said second pulley being rotatable with said first pulley in the absence of said predetermined resistive torque, the resistive torque on said first pulley being a function of the liquid in said pump means and being at least as high as said predetermined resistive torque with washing fluid in said tub and being less than said predetermined resistive torque with the washing fluid substantially removed from said tub.

8. A laundry apparatus as described in claim 7 wherein said clutch means includes a helical member fixed to said motor drive shaft and on which said first pulley climbs to a stop upon encountering a resistive pump torque load greater than said predetermined resistive load, said clutch means being operable to effect disengagement of said first and second pulleys until the resistive torque of the pump is less than the said predetermined resistive torque.

9. A laundry apparatus as described in claim 7 wherein said rotary positive displacement pump means comprises a turbine style pump operable for developing resistive torque to effect disengagement of said first and second pulleys and the removal of fluid from said tub without rotating said basket.

* * * * *